US009618163B2

(12) United States Patent
Power et al.

(10) Patent No.: US 9,618,163 B2
(45) Date of Patent: Apr. 11, 2017

(54) LED LAMP WITH ELECTRONICS BOARD TO SUBMOUNT CONNECTION

(71) Applicant: Cree, Inc., Durham, NC (US)

(72) Inventors: David Power, Morrisville, NC (US); Daniel J. VanEpps, Jr., Apex, NC (US); Bart P. Reier, Cary, NC (US); Mark Edmond, Raleigh, NC (US)

(73) Assignee: Cree, Inc., Durham, NC (US)

( * ) Notice: Subject to any disclaimer, the term of this patent is extended or adjusted under 35 U.S.C. 154(b) by 146 days.

(21) Appl. No.: 14/306,342

(22) Filed: Jun. 17, 2014

(65) Prior Publication Data

US 2015/0362168 A1 Dec. 17, 2015

(51) Int. Cl.
*F21V 29/00* (2015.01)
*F21K 99/00* (2016.01)
(Continued)

(52) U.S. Cl.
CPC ..... *F21K 9/1355* (2013.01); *F21K 9/23* (2016.08); *F21V 23/006* (2013.01); *F21V 23/06* (2013.01);
(Continued)

(58) Field of Classification Search
CPC . F21K 9/1355; F21K 9/23; F21K 9/60; F21V 23/06; F21V 29/773; F21V 23/006; F21Y 2101/00
(Continued)

(56) References Cited

U.S. PATENT DOCUMENTS 3,581,162 A 5/1971 Wheatley
5,463,280 A 10/1995 Johnson
(Continued)

FOREIGN PATENT DOCUMENTS

EP 1058221 A2 12/2000
EP 0890059 B1 6/2004
(Continued)

OTHER PUBLICATIONS

U.S. Appl. No. 13/838,398, filed Mar. 15, 2013.
(Continued)

*Primary Examiner* — Anh Mai
*Assistant Examiner* — Hana Featherly
(74) *Attorney, Agent, or Firm* — Dennis J. Williamson; Moore & Van Allen PLLC

(57) ABSTRACT

A LED lamp comprises an enclosure containing a reflective surface and an optically transmissive exit surface and a base. A LED assembly is mounted on a submount, is located in the enclosure and is operable to emit light when energized through an electrical path from the base. The submount comprises a connector portion having a first electrical contact that is in the electrical path. A first spring contact is electrically coupled to lamp electronics where the lamp electronics and the first spring contact are in the electrical path. A heat sink comprises a heat dissipating portion that is at least partially exposed to the ambient environment and a heat conducting portion that is thermally coupled to the LED assembly. The connector portion is inserted into the heat sink such that the first electrical contact creates an electrical contact coupling with the first spring contact.

40 Claims, 11 Drawing Sheets

(51) Int. Cl.

| | |
|---|---|
| ***F21V 23/06*** | (2006.01) |
| ***F21V 23/00*** | (2015.01) |
| ***F21K 9/23*** | (2016.01) |
| *F21V 29/77* | (2015.01) |
| *F21Y 101/00* | (2016.01) |
| *F21K 9/60* | (2016.01) |

(52) U.S. Cl.
CPC ..... *F21K 9/60* (2016.08); *F21V 29/773* (2015.01); *F21Y 2101/00* (2013.01)

(58) Field of Classification Search
USPC ..... 362/294
See application file for complete search history.

(56) References Cited

U.S. PATENT DOCUMENTS

| | | | | |
|---|---|---|---|---|
| 5,561,346 | A | 10/1996 | Byrne | |
| 5,585,783 | A | 12/1996 | Hall | |
| 5,655,830 | A | 8/1997 | Ruskouski | |
| 5,688,042 | A | 11/1997 | Madadi et al. | |
| 5,806,965 | A | 9/1998 | Deese | |
| 5,947,588 | A | 9/1999 | Huang | |
| 5,949,347 | A | 9/1999 | Wu | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,425,678 | B1 * | 7/2002 | Verdes | F21V 29/89 257/E25.019 |
| 6,465,961 | B1 | 10/2002 | Cao | |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 7,892,031 | B1 * | 2/2011 | Mostoller | H01J 5/50 313/317 |
| 7,965,023 | B1 | 6/2011 | Liang | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,249 | B2 | 10/2012 | Liang et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,427,037 | B2 | 4/2013 | Liang et al. | |
| 8,449,154 | B2 | 5/2013 | Uemoto et al. | |
| 8,502,468 | B2 | 8/2013 | Li et al. | |
| 8,556,465 | B2 | 10/2013 | Lee et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 2004/0201990 | A1 | 10/2004 | Meyer | |
| 2008/0310167 | A1 | 12/2008 | Zaderej et al. | |
| 2009/0184618 | A1 | 7/2009 | Hakata et al. | |
| 2010/0073931 | A1 | 3/2010 | Watanabe | |
| 2010/0277067 | A1 | 11/2010 | Maxik et al. | |
| 2011/0074290 | A1 | 3/2011 | Sakai et al. | |
| 2011/0140136 | A1 | 6/2011 | Daily et al. | |
| 2011/0234082 | A1 | 9/2011 | Cao | |
| 2011/0273102 | A1 | 11/2011 | Van De Ven et al. | |
| 2012/0025705 | A1 * | 2/2012 | Chang | F21K 9/1355 315/32 |
| 2012/0040585 | A1 | 2/2012 | Huang | |
| 2012/0069545 | A1 | 3/2012 | Choi et al. | |
| 2012/0188767 | A1 | 7/2012 | Igaki et al. | |
| 2012/0268936 | A1 | 10/2012 | Pickard et al. | |
| 2013/0026923 | A1 | 1/2013 | Athalye et al. | |
| 2013/0026925 | A1 | 1/2013 | Ven et al. | |
| 2013/0044501 | A1 * | 2/2013 | Rudisill | F21V 29/004 362/398 |
| 2013/0069535 | A1 | 3/2013 | Athalye | |
| 2013/0069547 | A1 | 3/2013 | Van De Ven et al. | |
| 2013/0119872 | A1 | 5/2013 | Chobot | |
| 2013/0127353 | A1 | 5/2013 | Athalye et al. | |
| 2013/0128573 | A1 | 5/2013 | Leung et al. | |
| 2013/0162149 | A1 | 6/2013 | Van De Ven et al. | |
| 2013/0162153 | A1 | 6/2013 | Van De Ven et al. | |
| 2013/0169159 | A1 | 7/2013 | Lys | |
| 2013/0170199 | A1 | 7/2013 | Athalye et al. | |
| 2013/0293135 | A1 | 11/2013 | Hu et al. | |
| 2014/0001959 | A1 | 1/2014 | Motley et al. | |
| 2014/0001963 | A1 | 1/2014 | Chobot et al. | |
| 2014/0167620 | A1 | 6/2014 | Chobot | |
| 2014/0167622 | A1 | 6/2014 | Chobot et al. | |
| 2014/0167623 | A1 | 6/2014 | Chobot et al. | |
| 2014/0167642 | A1 | 6/2014 | Chobot | |
| 2014/0167653 | A1 | 6/2014 | Chobot | |
| 2014/0268771 | A1 | 9/2014 | Heikman | |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

OTHER PUBLICATIONS

U.S. Appl. No. 14/052,336, filed Oct. 10, 2013.
U.S. Appl. No. 61/932,058, filed Jan. 27, 2014.
U.S. Appl. No. 14/189,330, Office Action, Apr. 28, 2015.
U.S. Appl. No. 14/189,330, Final Office Action, Oct. 23, 2015.
U.S. Appl. No. 14/189,330, Office Action, Apr. 14, 2016.

* cited by examiner

LED LAMP WITH ELECTRONICS BOARD TO SUBMOUNT CONNECTION

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments a LED lamp comprises an enclosure comprising an optically transmissive exit surface and a base. A LED assembly comprises at least one LED mounted on a submount and located in the enclosure and operable to emit light when energized through an electrical path from the base. The submount comprises a connector portion having a first electrical contact that is in the electrical path. A first spring contact is electrically coupled to lamp electronics where the lamp electronics and the first spring contact are in the electrical path. The connector portion extends toward the base such that the first electrical contact creates an electrical contact coupling with the first spring contact.

A reflective surface may be disposed in the enclosure. The reflective surface may generate a directional light pattern. A heat sink comprising a heat dissipating portion that is at least partially exposed to the ambient environment and a heat conducting portion that is thermally coupled to the at least one LED may be used. The heat sink may support the submount. The heat sink may be positioned between the enclosure and the base. The heat conducting portion may comprise a mounting surface that extends into the enclosure such that that LED assembly is positioned in the enclosure. The mounting portion may be disposed substantially transverse to the longitudinal axis of the lamp. The connector portion may be formed as a tab that is formed as one-piece with the submount. The submount may comprise a LED mounting surface and the tab may extend at an angle relative to the mounting surface. The tab may be bent relative to the mounting surface. The submount may be flexible and may comprise a flex circuit. The submount may comprise one of a metal core printed circuit board, a PCB, FR4 PCB, and a lead frame structure. A second spring contact may be in the electrical path and a second electrical contact may be on the connector portion such that the second electrical contact creates an electrical contact coupling with the second spring contact. The first spring contact and the second spring contact may each comprise resilient conductors that are deformed to create the electrical contact coupling. The electrical connector portion may extend from a side of the submount opposite to the at least one LED. An aperture may be formed in the heat sink for receiving the connector portion. The aperture may communicate an exterior of the heat sink with an interior cavity of the base. The aperture may be disposed such that the first spring contact is accessible through the aperture. A plug may be used to close the aperture. An outer surface of the plug may be highly reflective.

In some embodiments a LED lamp comprises an at least partially optically transmissive enclosure and a base. A LED assembly comprising at least one LED mounted on a submount and operable to emit light when energized through an electrical path from the base. The submount comprises a connector portion having a first electrical contact that is in the electrical path. A first spring contact is electrically coupled to lamp electronics where the lamp electronics and first spring contact are in the electrical path. The connector portion is inserted into the base such that the first electrical contact creates an electrical contact coupling with the first spring contact.

In some embodiments a LED lamp comprises an enclosure comprising an optically transmissive exit surface and a base. A LED assembly comprising at least one LED is mounted on a LED mounting portion of a submount. The LED is operable to emit light when energized through an electrical path from the base. The submount makes an electrical connection to the electrical path where the electrical connection is located behind the LED mounting portion.

The submount may comprise a connector portion that is in the electrical path. The connector portion may be formed as a tab that is formed as one-piece with the LED mounting portion. The tab may extend at an angle relative to the LED mounting portion. The tab may be bent relative to the LED mounting portion. The submount may be flexible. The submount may be mounted on an LED assembly mounting surface. The connector portion may extend toward the base from the submount and the LED assembly mounting surface may restrict access to the electrical connection. The connector portion may comprise a contact pad. The LED assembly mounting surface may comprise an opening for receiving the connector portion and a cover positioned over the opening. The base may comprise a standard electrical connector such as an Edison screw. Live electrical components may not be exposed on the LED mounting portion. The LED mounting portion may be located in the enclosure a distance from a first end of the enclosure. The electrical connection may be made on a surface of the submount, the at least one LED being mounted to the surface. The connector portion may extend from within the periphery of the submount. The submount may comprise an aperture and the electrical connection may be made behind the aperture. The electrical path may not be electrically exposed outside of the submount. The connector portion may be electrically coupled to the LED mounting portion by electrical traces on the connector portion and the LED mounting portion. The at least one LED may be directed along a longitudinal axis of the lamp where the longitudinal axis extends from the base to the enclosure.

DETAILED DESCRIPTION

Figure 1:
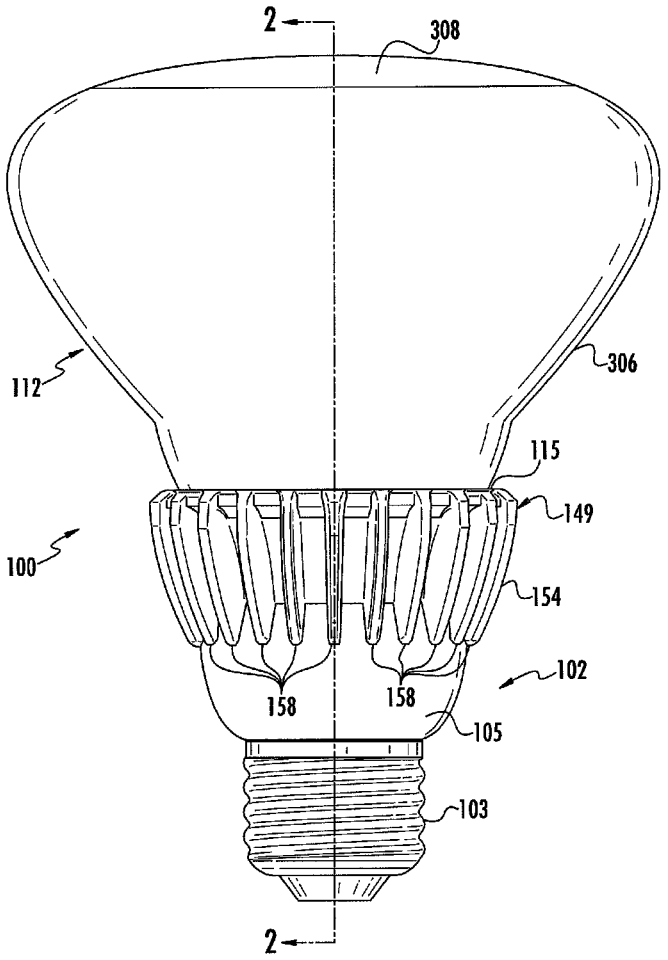
FIG. 1 is a front view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or submount is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a submount which may include sapphire, silicon, silicon carbide and/or other microelectronic submounts, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Embodiments of the present invention provide a solid-state lamp with centralized light emitters, more specifically, LEDs. Multiple LEDs can be used together, forming an LED array. The LEDs can be mounted on or fixed within the lamp in various ways. In at least some example embodiments, a submount is used. The LEDs are disposed at or near the central portion of the structural envelope of the lamp. Since the LED array may be configured in some embodiments to reside centrally within the structural envelope of the lamp, a lamp can be constructed so that the light pattern is not adversely affected by the presence of a heat sink and/or mounting hardware, or by having to locate the LEDs close to the base of the lamp. It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

One embodiment of a lamp 100 is shown in the figures and comprises a lamp base 102 such as an Edison base that functions as the electrical connector to connect the lamp 100 to an electrical socket or other power source. Depending on the embodiment, other base configurations are possible to make the electrical connection such as other standard bases or non-traditional bases. Base 102 may include the electronics 110 for powering lamp 100 and may include a power supply and/or driver and form all or a portion of the electrical path between the mains and the LEDs. Base 102 may also include only part of the power supply circuitry while some smaller components reside on the submount. An at least partially optically transmissive enclosure 112 contains an LED assembly 130 that includes at least one LED 127 that emits light when energized through an electrical path from the base 102. Electrical conductors run between the LED assembly 130 and the lamp base 102 to carry both sides of the supply to provide critical current to the LEDs 127 as will be described. A heat sink 149 is provided for thermal control to conduct heat away from the LED assembly 130 and to dissipate heat to the ambient environment.

The lamp 100 is a solid-state lamp comprising a LED assembly 130 with light emitting LEDs 127. The LED assembly 130 may be implemented using a submount 129 on which the LEDs 127 are mounted. Multiple LEDs 127 can be used together, forming an LED array. The LEDs 127 can be mounted on or fixed within the lamp in various ways. The LEDs 127 include LEDs which may comprise an LED die disposed in an encapsulant such as silicone, and LEDs which may be encapsulated with a phosphor to provide local wavelength conversion, as will be described later when various options for creating white light are discussed. A wide variety of LEDs and combinations of LEDs may be used in the LED assembly 130 as described herein. The LEDs 127 of the LED assembly 130 are operable to emit light when energized through an electrical connection. An electrical path runs between the submount 129 and the lamp base 102 to carry both sides of the supply to provide critical current to the LEDs 127. The LED assembly 130 is configured such that the LEDs 127 project light primarily away from the base 102 and toward an exit surface of the lamp.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light. Such embodiments can produce light with a CRI of at least 70, at least 80, at least 90, or at least 95. By use of the term substantially white light, one could be referring to a chromacity diagram including a blackbody 160 locus of points, where the point for the source falls within four, six or ten MacAdam ellipses of any point in the blackbody 160 locus of points. In some embodiments a CRI of 90 or higher may be achieved by providing: a light path that includes spectral notching material (e.g. neodymium or other filters coated on or within the enclosure); and/or high CRI light source/components that may include BSY+R LEDs; blue LEDs with yellow, green, and/or red phosphors (the phosphors may be mixed in a single layer within the component, or one or more of the phosphors may be in separate layers within the component); and/or spectral notching material incorporated with the component.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

In some embodiments, a driver and/or power supply are included with the LEDs 127 on the submount 129. In other embodiments the driver and/or power supply are included in the base 102 as shown. The power supply and drivers may also be mounted separately where components of the power supply are mounted in the base 102 and the driver is mounted with the submount 129 in the enclosure 112. Base 102 may include lamp electronics 110 including a power supply or driver and form a portion of the electrical path between the mains and the LEDs 127. The base 102 may also include only part of the power supply circuitry while some smaller components reside on the submount 129. In some embodiments any component that goes directly across the AC input line may be in the base 102 and other components that assist in converting the AC to useful DC may be in the enclosure 112. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

In one embodiment, the enclosure and base are dimensioned to be a replacement for directional lamps such as a PAR-style lamp, such as a replacement for a PAR-38 incandescent bulb, or a BR-style lamp. While specific reference has been made with respect to a directional lamp the lamp may be a replacement for an omnidirectional bulb such as ANSI standard A-series bulbs, including but not limited to A19, A21 and A23 bulb, such that the dimensions of the lamp 100 fall within the ANSI standards for such bulbs. The dimensions may be different for other ANSI standards. The structure and assembly method may be used on other lamps and in other embodiments and the LED lamp can have any shape, including standard and non-standard shapes. The enclosure may be made of glass, plastic or other optically transmissive material.

A wide variety of LEDs and combinations of LEDs may be used in the LED assembly 130. The LEDs 127 are operable to emit light when energized through an electrical path from base 102. In some embodiments, the LED lamp 100 comprises eight RBG LEDs manufactured and sold by CREE INC. The term "electrical path" is used to refer to the electrical path to the LED's 127, and may include an intervening power supply, drivers and/or other lamp electronics, and includes the electrical connection between the electrical connector that provides power to the lamp and the LED array. The term may also be used to refer to the electrical connection between the power supply and the LEDs and between the electrical connector to the lamp and the power supply. Electrical conductors run between the LEDs 127 and the lamp base 102 to carry both sides of the supply to provide critical current to the LEDs 127 as will be described. The LEDs 127 may be mounted on a submount 129 that may form a part of the electrical path to the LEDs. In the present invention the term "submount" is used to refer to the support structure that supports the individual LEDs or LED packages 127 and in may comprise a flex circuit, printed circuit board, metal core printed circuit board, lead frame extrusion, or the like or combinations of such structures. The electrical path runs between the submount 129 and the lamp base 102 to carry both sides of the supply to provide critical current to the LEDs 127.

The submount 129 may comprise a series of anodes and cathodes arranged in pairs for connection to the LEDs 127. In the illustrated embodiment eight pairs of anodes and cathodes are used for an LED assembly having eight LEDs 127; however, a greater or fewer number of anode/cathode pairs and LEDs may be used. Moreover, more than one submount 129 may be used to make a single LED assembly 130. Electrical connectors or conductors such as traces connect the anode from one pair to the cathode of the adjacent pair to provide the electrical path between the anode/cathode pairs during operation of the LED assembly 130. An LED or LED package 127 containing at least one LED is secured to each anode and cathode pair where the LED/LED package spans the anode and cathode. The LEDs/LED packages may be attached to the submount by soldering. The electrical conductors such as traces may be covered in an electrically insulating material such that no live electronics are exposed. In one embodiment, the exposed surfaces of the submount 129 may be coated with silver, white plastic or other reflective material to reflect light inside of enclosure 112 during operation of the lamp. The submount 129 may have a variety of shapes, sizes and configurations.

The submount 129 may comprise a LED mounting portion **129*a* that functions to mechanically support and electrically couple the LEDs 127 to the electrical path. The submount may be made of, or partially made of, a thermally conductive material. A large area of the submount 129 may be thermally conductive such that the entire LED assembly 130, or a large portion of the submount 129, transfers heat from the LEDs 127 to the heat sink 149. The submount 129 may be bent into the configuration of the LED assembly 130** as shown in the figures.

In one embodiment of LED assembly 130 the submount 129 comprises a flex circuit. A flex circuit may comprise a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 127 on the flex circuit and for creating the electrical path between the components. The traces may be covered by a protective layer or layers. In one method, the submount 129 is formed as a flat member and is bent into a suitable shape as will be described.

In some embodiments of LED assembly 130 the submount 129 may comprise a metal core board such as a metal core printed circuit board (MCPCB). The metal core board comprises a thermally and electrically conductive core made of aluminum or other similar pliable metal material. The core is covered by a dielectric material such as polyimide. Metal core boards allow traces to be formed therein to create the electrical pads for mounting the electrical components such as LEDs 127 and for creating the electrical path between the components. In one method, the submount 129 is formed as a flat member and is bent into a suitable shape.

The submount 129 may also comprise a PCB, flexible PCB or a PCB with FR4. The PCB, flexible PCB or PCB with FR4 may comprise thermal vias, where the thermal vias may then be connected to a lead frame structure for dissipating heat to the heat sink 149. The LED assembly may also comprise a PCB, flexible PCB or PCB FR4 without a lead frame structure. A PCB may comprise copper sheets laminated on a non-conductive submount. A PCB FR4 board comprises a thin layer of copper foil laminated to one side, or both sides, of an FR4 glass epoxy panel. Circuitry is etched or otherwise formed in the copper layers to create the electrical pads for mounting the electrical components such as LEDs 127 and for creating the electrical path between the components.

In some embodiments the submount 129 may comprise a lead frame structure. In a lead frame structure a thin layer of conductive material such as copper is formed into the circuit pattern to create the electrical pads for mounting the electrical components such as LEDs 127 and for creating the electrical path between the components.

In other embodiments of the LED assembly 130 the submount 129 may comprise a hybrid of such structures. In one embodiment, the exposed surfaces of the submount 129 may be coated with silver or other reflective material to reflect light inside of enclosure 112 during operation of the lamp. Moreover, more than one submount may be used to make a single LED assembly 130.

The base 102 comprises an electrically conductive Edison screw 103 for connecting to an Edison socket and may comprise a housing portion 105 connected to the Edison screw to create an internal cavity. The Edison screw 103 may be connected to the housing portion 105 by adhesive, mechanical connector, welding, separate fasteners or the like. The housing portion 105 may comprise an electrically insulating material such as plastic. In some embodiments the housing portion may be formed as part of the optically transmissive enclosure and the heat sink may be eliminated. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving a lamp electronics board 80 such as a PCB board on which the electronics 110 of the lamp including the power supply and/or drivers or a portion of the electronics for the lamp. The board 80 includes electrical connections to the lamp electronics and forms part of the electrical path to the LEDs. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

To provide electrical current from the lamp base 102 to the lamp electronics 110 on the board 80 a soldered, wired connection may be used between the conductive base such as Edison screw 103 and the lamp electronics board 80. In some embodiments, spring contacts may be used such that the electrical connection between the Edison screw 103 and the board 80 may be made without soldering or wires. The spring contacts are deformed into contact with the conductive terminals of the Edison base 103 when the lamp electronics board 80 is inserted into the Edison screw 103. This type of electrical connection is referred to herein as a electric contact coupling, as distinguished from a soldered coupling, and does not require soldering or wires.

The lamp electronics board 80 includes a first spring contact 96 and a second spring contact 98 that allow the lamp electronics 110 to be electrically coupled to the LED assembly 130 in the lamp using an electric contact coupling as will hereinafter be described. Spring contacts 96 and 98 may be secured to and electrically coupled with the printed circuit board 80 which includes the lamp electronics 110 such as the power supply, including large capacitor and EMI components that are across the input AC line along with the driver circuitry as described herein. The first spring contact 96 may be is electrically coupled to one of the anode or cathode side of the lamp electronics 110 and the second spring contact 98 may be electrically coupled to the other one of the anode or cathode side of the lamp electronics. The first spring contact 96 and the second spring contact 98 are arranged such that resilient conductors 99 extend from a side of the board 80. The spring contacts 96, 98 create an electrical connection between the anode side and the cathode side of the board 80 and the anode and cathode side of the LED assembly 129. The resilient conductors 99 are deformed when the submount 129 is mounted on the heat sink 149 to create the electrical contact coupling. The engagement between the spring contacts 96, 98 and the contact pads 130, 131 of the submount 129 is a contact coupling where the electrical connection is created by the contact under pressure between the resilient contacts 99 and the board as distinguished from a soldered coupling and does not require separate wires or soldering.

Referring again to the figures, the LED assembly 130 may be mounted to a heat sink structure 149. The heat sink structure 149 comprises a heat conducting portion 152 in the form of a pedestal that extends into enclosure 112 and comprises a LED assembly mounting surface 155. The mounting surface 155 for the LED assembly is disposed at a distance above the open neck 115 at the end of the enclosure such that the LEDs are disposed in the enclosure at a point beyond the end of the enclosure that joins the heat sink and/or base. The distance the pedestal extends into the enclosure may be determined by the desired light pattern of the lamp. The mounting surface extends substantially transversely to the longitudinal axis of the lamp (the longitudinal axis being the axis extending from the base toward the distal end of the lamp as represented by line 2-2 of FIG. 1) such that the LEDs are directed substantially along the longitudinal axis of the lamp. The heat sink structure 149 also comprises a heat dissipating portion 154. In one embodiment the heat sink 149 is made as a one-piece member of a thermally conductive material such as aluminum. The heat sink structure 149 may also be made of multiple components secured together to form the heat structure. Moreover, the heat sink 149 may be made of any thermally conductive material or combinations of thermally conductive materials.

The LED assembly support surface 155 may be formed as a planar member configured to make good thermal contact with the LED assembly 130 such that heat generated by the LED assembly 130 may be efficiently transferred to the heat sink 149. While the LED assembly 130 and the LED assembly support surface 155 are shown as being planar these components may have any configuration provided good thermal conductivity is created between the LED assembly 130 and the heat conducting portion 152. Further, while heat transfer may be most efficiently made by forming the heat conducting portion 152 and the LED assembly 130 with mating complimentary shapes, the shapes of these components may be different provided that sufficient heat is conducted away from the LED assembly 130 that the operation and/or life expectancy of the LEDs are not adversely affected.

The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 extends from the interior of the enclosure 112 to the exterior of the lamp 100 such that heat may be dissipated from the lamp to the ambient environment. In one embodiment the heat dissipating portion 154 is formed generally as a cylinder where a peripheral potion of the heat dissipating portion 154 extends outside of the lamp and forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

To attach the heat sink 149 to the base 102, first engagement members on the base 102 may engage mating second engagement members on the heat sink 149. In one embodiment, the first engagement members comprise deformable resilient fingers 101 that comprise a camming surface 107 and a lock member 109. The second engagement member comprises apertures 111 formed in the heat sink 149 that are dimensioned to receive the fingers 101. In one embodiment, the housing 105 of the base 102 is provided with fingers 101 that extend from the base 102 toward the heat sink 149. In the illustrated embodiment three fingers 101 are provided although a greater or fewer number of fingers may be provided. The fingers 101 may be made as one-piece with the housing 105. For example, the housing 105 and fingers 101 may be molded of plastic. The apertures 111 comprise fixed members 113 that may be engaged by the lock members 109 to lock the fingers 101 to the heat sink 149. The base 102 may be moved toward the bottom of the heat sink 149 such that fingers 101 are inserted into apertures 111 and the camming surfaces 107 of the fingers 101 contact the fixed members 113. The engagement of the fixed members 113 with the camming surfaces 107 deforms the fingers 101 to allow the locking members 109 to move past the fixed members 113. As the lock members 109 pass the fixed members 113 the fingers 101 return toward their undeformed state such that the lock members 109 are disposed behind the fixed members 113. The engagement of the lock members 109 with the fixed members 113 fixes the base 102 to the heat sink 149. The snap-fit connection allows the base 102 to be fixed to the heat sink 149 in a simple insertion operation without the need for any additional connection mechanisms, tools or assembly steps. While one embodiment of the snap-fit connection is shown numerous changes may be made. For example, the deformable members such as fingers may be formed on the heat sink 149 and the fixed members such as apertures may be formed on the base 102. Moreover, both engagement members may be deformable. Further, rather than using a snap-fit connection the base 102 may be fixed to the heat sink using other connection mechanisms such as adhesive, screwthreads, friction fit or the like.

The LED assembly mounting surface 155 comprises an aperture 160 that communicates the exterior of the heat sink 149 with the interior cavity of the base 102. The aperture 160 is disposed such that the spring contacts 96, 98 on the lamp electronics board 80 are disposed below and are accessible through the aperture 160. The heat sink 149 is formed with a support surface 162 that is disposed opposite to the spring contacts 96, 98 from the PCB. The support surface 162 is spaced from the spring contacts 96, 98 and lamp electronics board 80 a distance such that an electrical connector portion 140 of the submount 129 may be inserted between the spring contacts 96, 98 and the support surface 162.

The submount 129 is formed with an electrical connector portion 140 that extends from the LED mounting portion 129*a* of the submount 129 and in one embodiment the electrical connector portion 140 extends toward the side of the submount 129 opposite the LEDs 127. The electrical connector portion 140 may be formed as a tab that is an integral as part of the submount 129 such that the tab and submount are formed as a single, one-piece member. The tab may be formed by bending a portion of the submount 129 relative to the LED mounting portion 129*a* such that the tab extends at an angle relative to the mounting portion 129*a* of the submount 129. For example, where the submount 129 comprises a flex circuit a portion of the flex circuit may be easily bent to create the tab. Other embodiments of the submount 129 such as an MCPCB and lead frame may also be easily bent to create the tab. For a submount that is easily bent or otherwise shaped the tab may be created during assembly of the lamp. In some embodiments such as a PCB, PCB FR4 board the board may be rigid such that the connector portion 140 may be formed during formation of the submount 129. While in one embodiment the electrical connector portion 140 and the LED mounting portion 129*a* of the submount 129 are formed as one-piece, in some embodiment these components may be separate members that are electrically and physically coupled to one another. However, making the electrical connector portion 140 and the LED mounting portion 129*a* of the submount 129 as one-piece may provide the simple and most cost effective solution. The electrical components on the submount and the electrical components on the electrical connector portion 140 may be electrically connected by a traces or other conductors that extend from the electrical connector portion 140 to the LED mounting portion 129*a*. The attachment between the lamp electronics and the electrical connector portion 140 may be on the same side of the substrate that the LEDs 127 are mounted while the electrical connector portion 140 is configured to extend below or behind the LED mounting portion 129*a*.

The electrical connector portion 140 supports two electrical contact pads 130, 131 that are connected to the electronics on the submount 129 and that form part of the electrical path to the LEDs 127. When the submount 129 is mounted on the mounting surface 155 of the heat sink 149 the electrical connector portion 140 is inserted into the aperture 160 and is inserted between the spring contacts 96, 98 and the support surface 160. The pads 130, 131 are positioned on the electrical connector portion 140 such that when the electrical connector portion is inserted through aperture 160 and into the base 102 the pads 130, 131 are disposed opposite to the spring contacts 96, 98.

The resilient conductors 99 of spring contacts 96, 98 are deformed as the electrical connector portion 140 is inserted toward the base 102. Specifically, as the electrical connector portion 140 is inserted though the aperture 160 the resilient conductor 99 of first spring contact 96 is deformed by and creates an electrical contact coupling with the first pad 130 and the second resilient conductor 99 of the second spring contact 98 contacts and is deformed by and creates an electrical contact coupling with the second pad 131. The physical contact between the spring contacts 96, 98 and the pads 130, 131 creates electrical contact couplings. The bias force created by the deformation of the resilient conductors 99 with the pads 130, 131 ensures a good electrical connection between the lamp electronics board 80 and the submount 129 without requiring soldering or wires. The submount 129 may be secured to the mounting surface by thermal epoxy, fasteners such as screws, mechanical locking members or the like. The electrical connection between the submount 129 and the lamp electronics is made behind or below the LED mounting portion 129*a* that supports the LEDs. In some embodiments the heat sink comprises a surface 155 on which the submount 129 is mounted and the electrical connection between the submount 129 and the lamp electronics is made on a surface opposite to the mounting surface 155. The electrical connector portion 140 may be disposed inside the periphery of the substrate such that the substrate surrounds the electrical connector portion 140 and the electrical connection between the substrate and the lamp electronics. The electrical connector portion 140 and LED mounting portion 129*a* may create an aperture 133 in the submount 129. The electrical connector portion 140 and the connection between the lamp electronics and the electrical connector portion 140 may be in the base, within the enclosure or partially within the base and the enclosure.

In some embodiments such as shown in the figures, the live electrical components such as spring contacts 96, 98 and pads 130, 131 may be accessible to a person through aperture 160 in the event that the enclosure 112 shatters. Certain safety standards such as UL (Underwriter's Laboratory) requirements may require that a user's accessibility to live electrical components be restricted or isolated from a user. In some embodiments, the live electrical components are located behind the mounting surface 155 and/or behind the LED mounting portion 129*a*. The live electrical components may be separated from the user by dimensioning the aperture 160 and/or the spaces between the electrical components to be small enough that access to the electrical path by a user is restricted. The live electrical components on the LED mounting portion 129*a*, such as traces, are covered in a dielectric or thermal insulating material such that the surface of the LED mounting portion does contain exposed live electrical components. The arrangement of the electrical connection between the electrical connector portion 140 and the lamp electronics board behind the LED mounting portion 129*a* and LED assembly mounting surface 155 prevents a person accessing these live components from the outside of the base in the event the enclosure breaks. The size of the aperture 133 on the submount 129 and/or the size of the aperture 160 in the LED as assembly mounting surface 155 are dimensioned to prevent a person's finger from being inserted through the apertures and contacting the live components. Thus, even in the event the enclosure fails or breaks a user is prevented from touching the live components with their finger.

Figure 10:
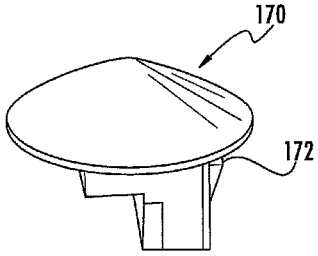
FIGS. 10 and 11 are perspective views of embodiments of the plug usable in the lamp of FIG. 1.
Figure 11:
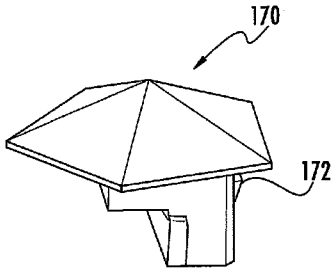

In some embodiments a plug 170 may be used to close the aperture 160. The plug 170 may be force fit into the aperture 160 or locking mechanisms may be provided to lock the plug 170 in place. For example, the plug 170 may comprise deformable tangs that engage detents on the heat sink such that a mechanical lock is created. In other embodiments deformable fingers 172 similar to fingers 101 may be provided on the plug 170 that are inserted into the aperture and that engage an edge of the heat sink. Other mechanisms including adhesive, separate fasteners and the like may be used to secure the plug 170 to the heat sink 149. Because the plug 170 is in the enclosure 112 and, in at least some embodiments, may be mounted on the submount 129, the plug 170 may be designed to shape the light emitted by the lamp. For example, the plug 170 may be made of or covered by a highly reflective material such as reflective paint, white optics, PET, MCPET, or other reflective materials. The reflective surface may be made of a specular material such as injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet. The plug 170 may also be shaped to reflect light in a desired pattern. For example the plug 170 may have an exposed faceted surface (FIG. 9), conical surface (FIG. 10), a pyramidal surface (FIG. 11), a parabolic surface or other curved and/or faceted surface shaped to reflect light toward the reflective surface of the housing or toward the optically transmissive portion of the enclosure.

The enclosure 112 may be attached to the heat sink 149. In one embodiment, the LED assembly 130 is inserted into the enclosure 112 through the neck 115. The neck 115 and heat sink dissipation portion 154 are dimensioned and configured such that the rim 112*a* of the enclosure 112 sits on the upper surface 154*a* of the heat dissipation portion 154 with the heat dissipation portion 154 disposed at least partially outside of the enclosure 112, between the enclosure 112 and the base 102. To secure these components together a bead of adhesive may be applied to the upper surface 154*a* of the heat dissipation portion 154. The rim of the enclosure 112 may be brought into contact with the bead of adhesive to secure the enclosure 112 to the heat sink 149 and complete the lamp assembly. In addition to securing the enclosure 112 to the heat sink 149 the adhesive may be deposited over the snap-fit connection formed by fingers 101 and apertures 111. The adhesive flows into the snap fit connection to permanently secure the heat sink to the base.

Figure 2:
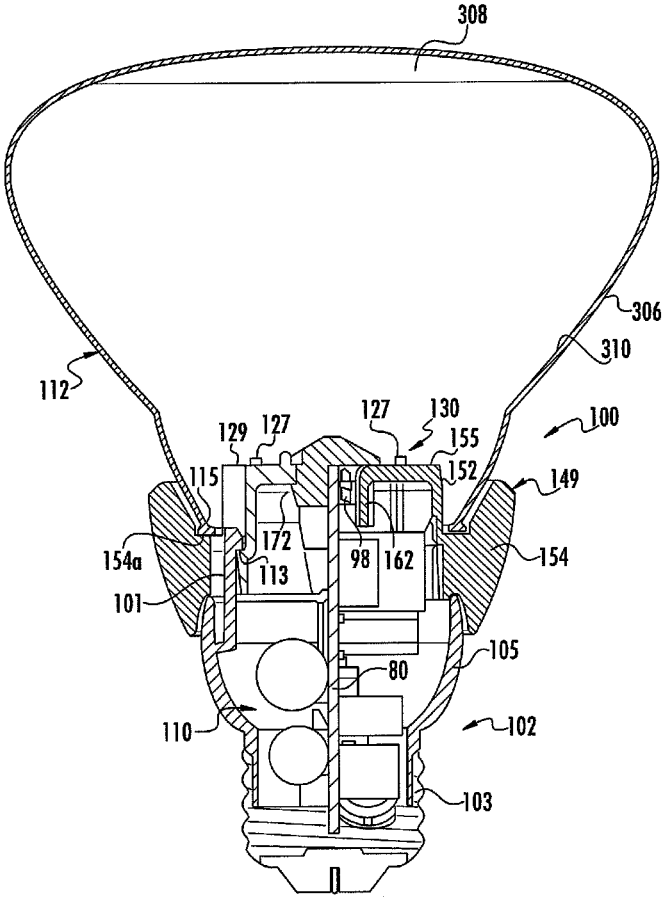
FIG. 2 is a section view taken along line 2-2 of FIG. 1.
Figure 3:
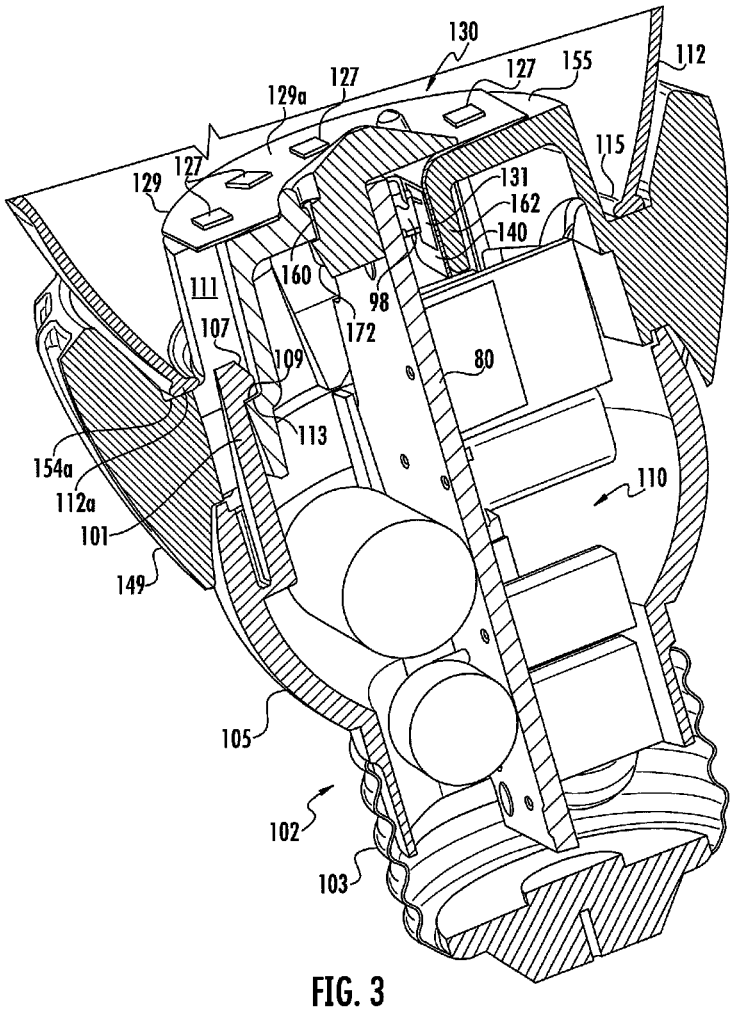
FIG. 3 is a partial perspective section view of the lamp of FIG. 1.
Figure 4:
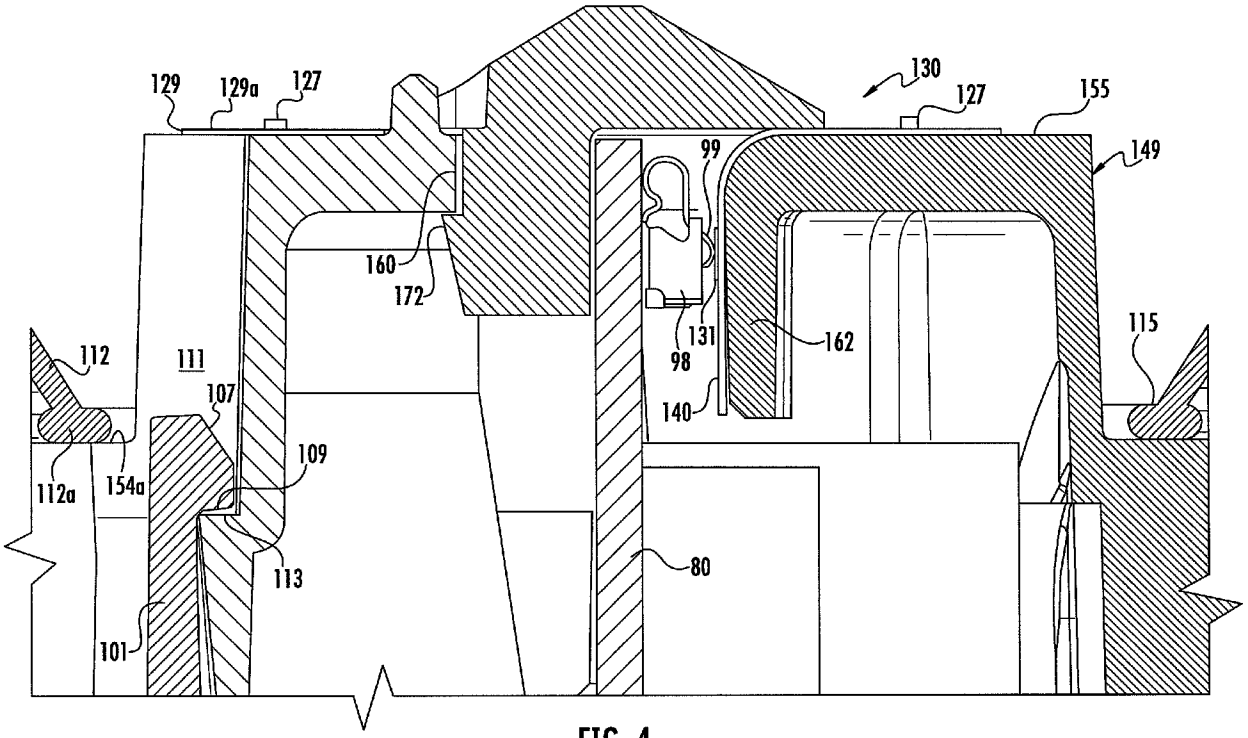
FIG. 4 is a detailed section view of the lamp of FIG. 1.
Figure 5:
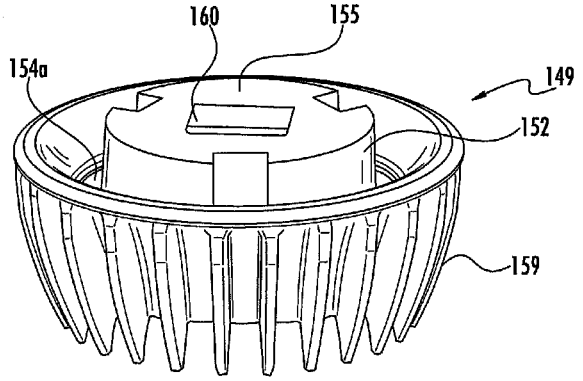
FIG. 5 is a perspective view of an embodiment of the heat sink of the lamp of FIG. 1.
Figure 6:
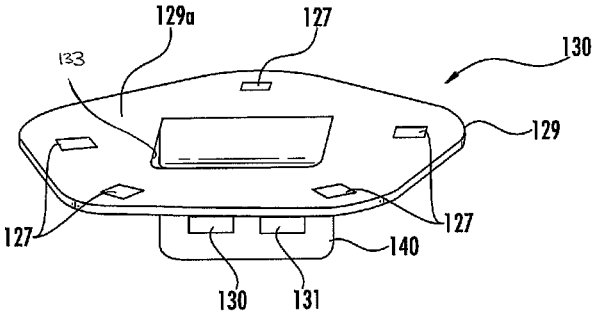
FIG. 6 is a perspective view of an embodiment of the LED assembly of the lamp of FIG. 1.
Figure 7:
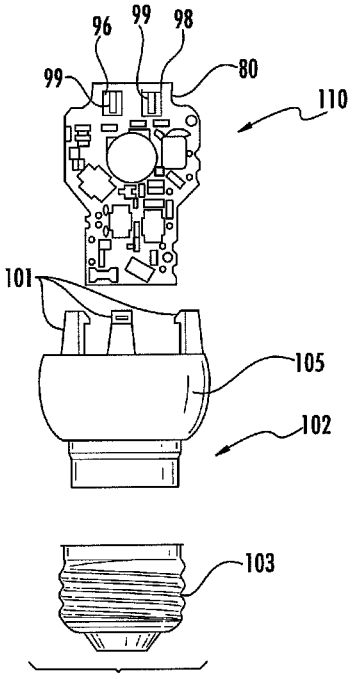
FIG. 7 is an exploded view of the base of the lamp of FIG. 1.
Figure 8:
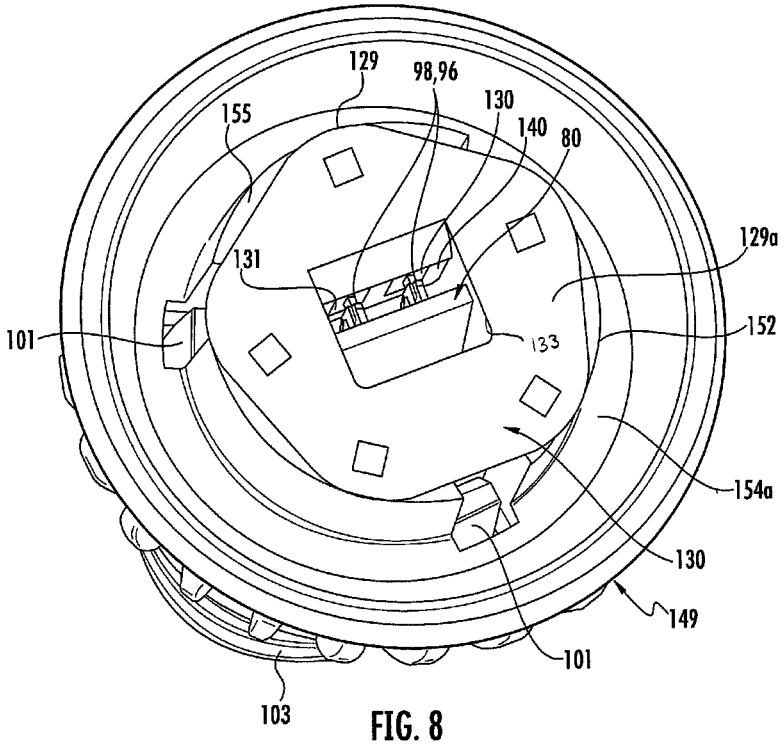
FIG. 8 is a perspective view of the LED assembly of the lamp of FIG. 1.
Figure 12:
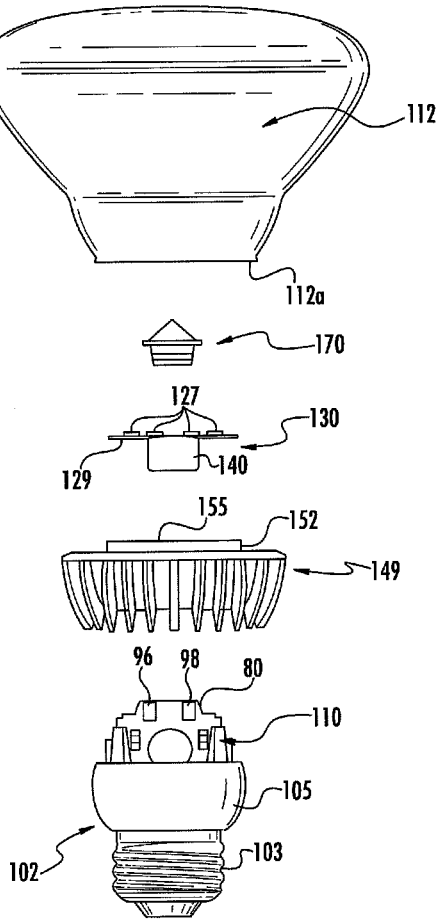
FIG. 12 is an exploded view of the lamp of FIG. 1.

In the BR or PAR lamp shown in FIGS. 1, 2 and 12 the light is emitted in a directional pattern rather than in an omnidirectional pattern. Standard BR type bulbs are reflector bulbs that reflect light in a directional pattern; however, the beam angle is not tightly controlled and may be up to about 90-100 degrees or other fairly wide angles. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. The lamp 100 may be used as a solid state replacement for such reflector type PAR and/or BR bulbs.

To create a directional light pattern, enclosure 112 comprises a reflective surface 310 that may be provided inside of the lamp body or housing 306 and that reflects light generated by the LED assembly 130 generally in a direction along the axis of the lamp. The reflective surface 310 surrounds the LED assembly 130 and reflects some of the light generated by the LED assembly 130. Because the reflective surface 310 may be at least 95% reflective, the more light that hits the reflective surface 310 the more efficient the lamp. The reflective surface 310 may reflect the light in a narrow beam angle. The reflective surface 310 may comprise a variety of shapes and sizes provided that light reflecting off of the reflective surface is reflected generally along the axis of the lamp in a relatively narrow beam angle. The reflective surface 310 may, for example, be conical, parabolic, hemispherical, faceted or the like. In some embodiments, the reflective surface 310 may be a diffuse or Lambertian reflector and may be made of a white highly reflective material such as injection molded plastic, white optics, PET, MCPET, or other reflective materials. The reflective surface may reflect light but also allow some light to pass through it. The reflective surface may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's Vikuiti ESR (Enhanced Specular Reflector) film. It could also be formed aluminum, or a flower petal arrangement in aluminum using Alanod's Miro or Miro Silver sheet. The reflective surface 310 may also comprise a polished metal surface. For example, where housing or body 306 is made of a material such as aluminum the interior surface of the housing may be polished. In some embodiments the reflective surface may comprise an inside surface of the housing 306 and may include a reflective layer applied to or attached to the interior surface of the housing. The housing 306 may also be made of glass or plastic where the reflective surface 310 is applied to a portion of the housing and the remaining portion of the housing creates an optically transmissive lens or exit surface 308. Some of the light generated by the LED assembly 130 may also be projected directly out of the lens or exit surface 308 without being reflected by the reflective surface 310. In some embodiments the housing 306 and lens 308 may be separate components joined together to create the enclosure 112.

Figure 13:
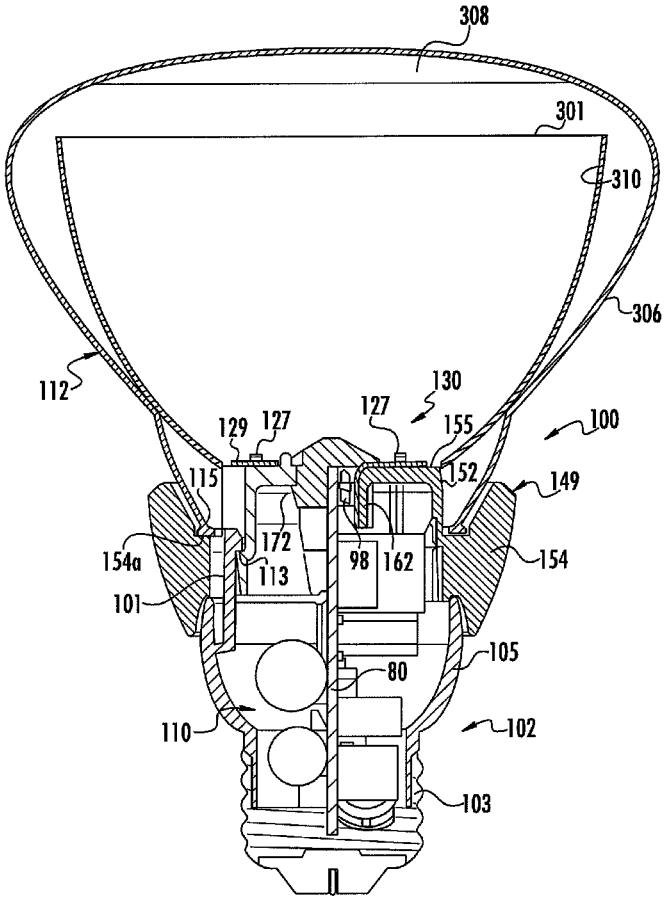
FIG. 13 is a section view of an alternate embodiment of the lamp of the invention.

In other embodiments the reflective surface 310 may be formed as a part of a separate reflector component 301 that is mounted inside of housing 306 as shown in FIG. 13. The reflector component 301 is mounted inside of the housing 306 such that the reflective surface 310 of the reflector component 301 reflects the light emitted from the LED assembly in a desired pattern. The reflector component 301 may be attached to the housing 306 such as by using adhesive, welding mechanical connection or a separate fastener. The reflector component 301 may also be secured to the heat sink 149 and/or LED assembly 130 in place of or in addition to being secured to the housing 306.

The reflective surface 310 may be shaped to produce a directional light pattern of a specific shape. For example, the reflective surface 310 may be formed as a parabolic reflector, a facted reflector, a conical reflector or other curved shape. In other embodiments, the reflector may have a shape to produce a desired directional pattern and in some embodiments the formation of the directional light pattern may be created by the lens 308 such that the reflective surface 310 may have any shape that reflects the light toward the lens without necessarily creating a directional beam of light. The lens 308 may be used to focus the light reflected from the reflective surface 310 to create a beam of light at the desired beam angle. In some embodiments the lens 308 may comprise a glass or plastic lens and may have a diffusing layer formed as part of the lens or a diffusing layer may be formed on the lens. The diffusing layer may comprise a coating on the lens, etching of the lens, the property of the lens material or other diffusing mechanism. The surface texture of lens 308 may comprise of dimpling, frosting, etching, coating or any other type of texture that can be applied to a lens to diffuse the light exiting the lamp. The textured surface of the lens can be created in many ways. For example, a smooth surface could be roughened. The surface could be molded with textured features. Such a surface may be, for example, prismatic in nature. A lens according to embodiments of the invention can also consist of multiple parts co-molded or co-extruded together. For example, the textured surface could be a second material co-molded or co-extruded with the lens.

A lamp constructed using the reflective surface 310 and the lens 308 may produce light with a beam angle that varies from a wide angle flood pattern to a tightly controlled spot pattern. As a result, the construction allows the lamp to replace either a wide angle lamp such as a BR lamp or a narrow beam angle lamp such as a PAR lamp.

In some embodiments the housing 306 may comprise a thermally conductive material such as aluminum although other thermally conductive materials may be used. The housing may be thermally coupled to the heat sink 149 such as by direct surface to surface contact such that the housing forms part of the heat dissipating structure of the lamp.

With respect to the features described above with various example embodiments of a lamp, the features can be combined in various ways. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array. Any aspect or features of any of the embodiments described herein can be used with any feature or aspect of any other embodiments described herein or integrated together or implemented separately in single or multiple components.

Figure 9:
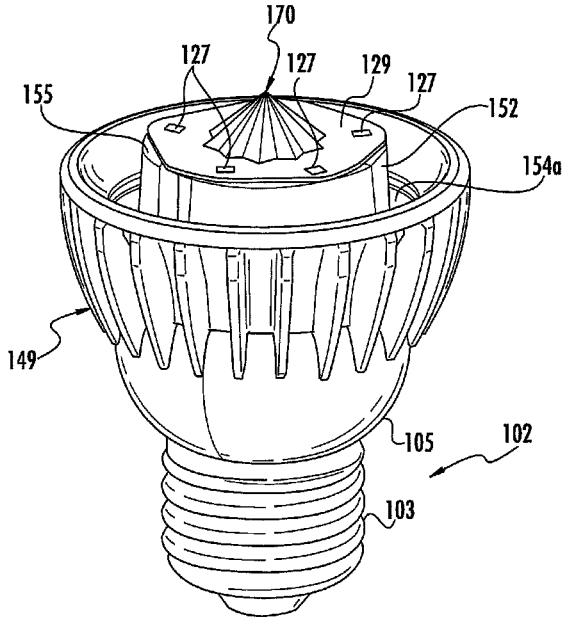
FIG. 9 is a perspective view of the lamp of Fig. with the enclosure removed.
Figure 14:
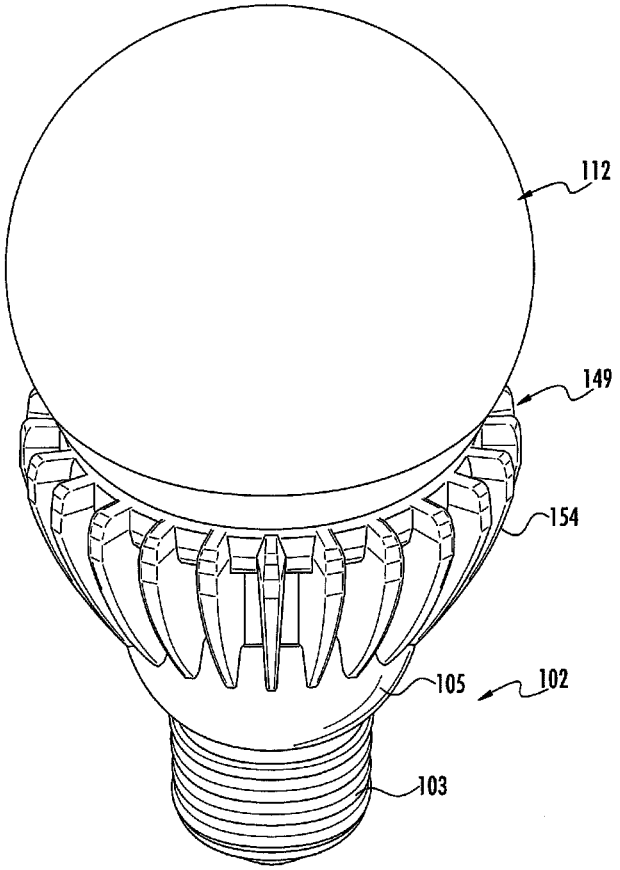
FIG. 14 is a perspective view of another embodiment of the lamp of the invention.

In some embodiments the form factor of the lamp is configured to fit within the existing standard for a lamp such as the A19 ANSI standard as shown in FIG. 14 such that the lamp may be a replacement for a standard bulb. The enclosure 112 may have a globe shape where the entire enclosure is optically transmissive to emit an omnidirectional light pattern. The lamp of FIG. 14 may comprise the heat sink with the pedestal support 149, submount 129 with electrical connection portion 140 and LED board 80 with spring contacts 96, 98 as shown in FIG. 9 and as previously described. The number and types of LEDs and the orientation of the LEDs in the enclosure may be selected to create a more omnidirectional light pattern than the LED assembly shown and described previously. Moreover, in some embodiments the size, shape and form of the LED lamp may be similar to the size, shape and form of traditional incandescent bulbs. Users have become accustomed to incandescent bulbs having particular shapes and sizes such that lamps that do not conform to traditional forms may not be as commercially acceptable. The LED lamp of the invention is designed to provide desired performance characteristics while having the size, shape and form of a traditional incandescent bulb.

In some embodiments an antenna may be provided in the bulb for receiving, and/or transmitting, a radio signal or other wireless signal between the lamp and a control system and/or between lamps. The antenna may convert the radio wave to an electronic signal that may be delivered to the lamp electronics 110 for controlling operation of the lamp. The antenna may be mounted on the board and be in communication with the lamp electronics. The antenna may also be used to transmit a signal from the lamp. The antenna may be positioned inside of the enclosure 112 such that the base 102 including Edison screw 103 do not interfere with signals received by or emitted from antenna. While the antenna is shown in the enclosure 112, the antenna may be located in the enclosure 112 and/or base 102. The antenna may also extend entirely or partially outside of the lamp. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure comprising an optically transmissive exit surface;

a base;

a LED assembly comprising at least one LED mounted on a submount and located in the enclosure and operable to emit light when energized through an electrical path from the base, the submount comprising a connector portion having a first electrical contact that is in the electrical path;

a first spring contact electrically coupled to lamp electronics, the lamp electronics and the first spring contact being in the electrical path;

the connector portion extending toward the base such that the first electrical contact creates an electrical contact coupling with the first spring contact.

2. The lamp of claim 1 wherein a reflective surface is disposed in the enclosure.

3. The lamp of claim 2 wherein the reflective surface generates a directional light pattern.

4. The lamp of claim 1 further comprising a heat sink comprising a heat dissipating portion that is at least partially exposed to the ambient environment and a heat conducting portion that is thermally coupled to the at least one LED, the heat sink supporting the submount.

5. The lamp of claim 4 wherein the heat sink is positioned between the enclosure and the base.

6. The lamp of claim 4 wherein the heat conducting portion comprises a LED assembly supporting surface that extends into the enclosure such that that LED assembly is positioned in the enclosure.

7. The lamp of claim 6 wherein the LED assembly supporting surface is disposed substantially transverse to the longitudinal axis of the lamp.

8. The lamp of claim 1 wherein the connector portion is formed as a tab that is formed as one-piece with the submount.

9. The lamp of claim 8 wherein the submount comprises a LED mounting surface and the tab extends at an angle relative to the mounting surface.

10. The lamp of claim 8 wherein the tab is bent relative to the mounting surface.

11. The lamp of claim 1 wherein the submount is flexible.

12. The lamp of claim 1 wherein submount comprises a flex circuit.

13. The lamp of claim 1 wherein the submount comprises one of a metal core printed circuit board, a PCB, FR4 PCB, flexible PCB and a lead frame structure.

14. The lamp of claim 1 further comprising a second spring contact in the electrical path and a second electrical contact on the connector portion such that the second electrical contact creates an electrical contact coupling with the second spring contact.

15. The lamp of claim 14 wherein the first spring contact and the second spring contact each comprise resilient conductors that are deformed to create the electrical contact coupling.

16. The lamp of claim 1 wherein the electrical connector portion extends from a side of the submount opposite to the at least one LED.

17. The lamp of claim 4 wherein an aperture is formed in the heat sink for receiving the connector portion.

18. The lamp of claim 17 wherein the aperture communicates an exterior of the heat sink with an interior cavity of the base.

19. The lamp of claim 17 wherein the aperture is disposed such that the first spring contact is inaccessible through the aperture.

20. The lamp of claim 17 further comprising a plug that closes the aperture.

21. The lamp of claim 20 wherein an outer surface of the plug is highly reflective.

22. A lamp comprising:

an at least partially optically transmissive enclosure;

a base;

a LED assembly comprising at least one LED mounted on a submount and operable to emit light when energized through an electrical path from the base, the submount comprising a connector portion having a first electrical contact that is in the electrical path;

a first spring contact electrically coupled to lamp electronics, the lamp electronics and first spring contact being in the electrical path;

the connector portion being inserted into the base such that the first electrical contact creates an electrical contact coupling with the first spring contact.

23. A lamp comprising:

an enclosure comprising an optically transmissive exit surface;

a base where a longitudinal axis extends from the base to a distal end of the enclosure;

a LED assembly comprising a plurality of LEDs mounted on a LED mounting portion of a submount, the plurality of LEDs being operable to emit light when energized through an electrical path from the base, the mounting portion comprising a planar member disposed transversely to the longitudinal axis, the submount comprising a connector portion that extends behind the LED mounting portion to make an electrical connection to lamp electronics at an electrical contact coupling, the lamp electronics and the connector portion being in the electrical path, the connector portion being disposed in the center of the LED mounting portion such that the plurality of LEDs are disposed around the outside of the connector portion.

24. The lamp of claim 23 wherein the connector portion is formed as a tab that is formed as one-piece with the LED mounting portion.

25. The lamp of claim 24 wherein the tab extends at an angle relative to the LED mounting portion.

26. The lamp of claim 25 wherein the tab is bent relative to the LED mounting potion.

27. The lamp of claim 25 wherein the submount is flexible.

28. The lamp of claim 23 wherein the submount is mounted on an LED assembly mounting surface.

29. The lamp of claim 28 wherein the connector portion extends toward the base from the LED mounting portion and the LED assembly mounting surface restricts access to the electrical connection.

30. The lamp of claim 29 wherein the LED assembly mounting surface comprises an opening for receiving the connector portion and a cover positioned inside of the enclosure and over the opening.

31. The lamp of claim 23 wherein the connector portion comprises a contact pad.

32. The lamp of claim 23 wherein the base comprises a standard electrical connector.

33. The lamp of claim 32 wherein the standard electrical connector comprises an Edison screw.

34. The lamp of claim 23 wherein live electrical components are not exposed on the LED mounting portion.

35. The lamp of claim 23 wherein the LED mounting portion is located in the enclosure a distance from a first end of the enclosure.

36. The lamp of claim 23 wherein the electrical connection is made on a surface of the submount, the plurality of LEDs being mounted to the surface.

37. The lamp of claim 23 wherein the submount comprises an aperture and the electrical connection is made behind the aperture.

38. The lamp of claim 37 wherein the electrical path is not electrically exposed outside of the submount.

39. The lamp of claim 23 wherein the connector portion is electrically coupled to the LED mounting portion by electrical traces on the connector portion and the LED mounting portion.

40. The lamp of claim 23 wherein the plurality of LEDs are directed along the longitudinal axis of the lamp.

* * * * *